US009673587B2

(12) United States Patent
Pechter et al.

(10) Patent No.: US 9,673,587 B2
(45) Date of Patent: Jun. 6, 2017

(54) AUTOMATIC-ROBOTIC-CABLE-CONNECTOR-ASSEMBLY METHOD

(71) Applicant: Frisimos, Ltd., Raanana (IL)

(72) Inventors: Tal Pechter, Ramat Hasharon (IL); Hanan Ben Ron, Givataim (IL)

(73) Assignee: Frisimos, Ltd., Raanana (IL)

( * ) Notice: Subject to any disclaimer, the term of this patent is extended or adjusted under 35 U.S.C. 154(b) by 327 days.

(21) Appl. No.: 14/335,474

(22) Filed: Jul. 18, 2014

(65) Prior Publication Data

US 2016/0285221 A1 Sep. 29, 2016

Related U.S. Application Data

(60) Provisional application No. 61/857,056, filed on Jul. 22, 2013.

(51) Int. Cl.

| | |
|---|---|
| ***H01R 43/02*** | (2006.01) |
| ***H01R 43/28*** | (2006.01) |
| ***H01R 43/05*** | (2006.01) |

(52) U.S. Cl.
CPC ..... *H01R 43/28* (2013.01); *H01R 43/0249* (2013.01); *H01R 43/05* (2013.01)

(58) Field of Classification Search
CPC ..... H01B 13/013; H01B 13/01272; H05K 13/06; H01R 43/0249; H01R 43/05; H01R 43/28
See application file for complete search history.

(56) References Cited

FOREIGN PATENT DOCUMENTS

| | | | |
|---|---|---|---|
| CN | 2454093 Y | * | 10/2001 |
| JP | 7065652 A | * | 3/1995 |

* cited by examiner

*Primary Examiner* — Carl Arbes
(74) *Attorney, Agent, or Firm* — Brinks Gilson & Lione

(57) ABSTRACT

An automatic-robotic-system-for-cable assembly is provided. The system is configured to detect the inner-wire placement. The detected inter-wire is conveyed toward a connector's relevant pad. In addition the robotic system is configured to associate the inner wire to the connector's relevant pad.

14 Claims, 14 Drawing Sheets

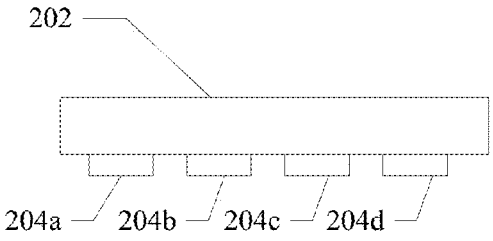
FIG.2a
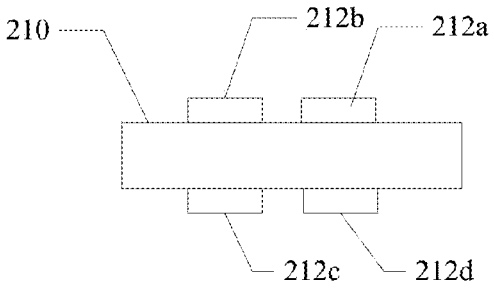
FIG.2b
| Pin | Name | Cable color | Description |
|---|---|---|---|
| 1 | VCC | Red | +5 VDC |
| 2 | D- | White | Data - |
| 3 | D+ | Green | Data + |
| 4 | GND | Black | Ground |
FIG.2c

AUTOMATIC-ROBOTIC-CABLE-CONNECTOR-ASSEMBLY METHOD

REFERENCE TO RELATED APPLICATION

The application claims the benefit of U.S. Provisional Application No. 61/857,056, filed on Jul. 22, 2013, which is incorporated by reference herein in its entirety.

TECHNICAL FIELD

The present disclosure generally relates to cable and connector industry, and more particularly the disclosure relates to a system and method of assembly connectors and cables.

BACKGROUND ART

Various systems and/or devices from similar or different fields can interact with each other. Example of fields may be: multimedia, telecommunications, vehicle electrical systems, home compliance, etc.

Interaction between devices and/or systems may be for different functions. Functions include, but are not limited to: control; information sharing; storage; communication between different entities; a combination of two or more of the above as well as other.

As non-limiting examples: an external-hard disc device may store data obtained from a computer; a television device may obtain video and audio from a DVD (digital versatile disc) and/or a personal media player; a computer may control a printer or scanner; a Wi-Fi (Wireless Fidelity) transceiver may be connected to a computer for wireless connection to the internet or other devices/systems; and so on.

The connectivity between different media and/or systems and/or devices is possible partially due to different types of: connector; converters; regulation; protocols; etc. Some of the connectivity between the different devices and/or systems may be via: physical connectors and cables, wireless connections, and/or a combination of them. A device and/or system may be connected to one or more other devices/systems via different connection type.

Each device and/or system may have specific connectivity requirements. Connectivity requirements may be physical connectivity requirements and/or protocol communication requirements, for example. Physical connectivity requirements may include: input and output data interface requirements; input and output voltage requirements; etc. Protocol communication requirements may include, for instance, data transfer protocol requirements.

Thus, different fields/systems/devices may have different standard and/or custom connector having designated parameters. Example of connector's parameters may be: size, labeling, interface parameters, structure, etc. Interface parameters may include: number of connectivity pads (pins), the layout of the connectivity pads and their physical size, and so on.

There are many types of different connectors. Examples of different standard connector types are: An eight positions-eight conductors (8P8C) a modular connector with eight positions all containing conductors most famous for its use in Ethernet; A D– subminiature electrical connector commonly used for the RS-232 serial port on: modems, computers, telecommunications, test and measurement instruments; An HDMI connector (High-Definition Multimedia Interface) compact audio/video interface for transferring uncompressed video data and compressed/uncompressed digital audio data from a HDMI-compliant device ("the source device") to a compatible computer monitor, video projector, digital television, or digital audio device;

A Universal Serial Bus (USB) connector a serial bus standard to interface devices, widely used among personal computers (PCs), APPLE MACINTOSH and many other devices, some types of USB 2.0 have a 4-pin connector USB 3.0 has 9 pins, surrounded by a shield; A Power connector which often include a safety ground connection as well as the power conductors for different household equipment; A RF Connector used at radio frequencies having constant impedance of its transmission line; a R-TNC (Reverse threaded Neill-Concelman) connector used for Wi-Fi antennas; A BNC connector is common for radio and test equipment; DC connector an electrical connector for supplying direct current (DC) power; Hybrid connectors having housings with inserts that allow intermixing of many connector types, such as those mentioned above; optical fiber connectors; and many more different types of connectors.

Each field/system/device may have a standard or custom electrical cable having different parameters. Example of electrical cable's parameters may include: length, cable diameter, number of inner-wire, inner-wire coloring, inner-wire diameter, cable color, labeling, insulation/shielding, winding/twisting, a combination of these as well as other parameters.

A cable is most often two or more wires running side by side and bonded, twisted, or braided together to form a single assembly. Any current-carrying conductor, including a cable, radiates an electromagnetic field. Likewise, any conductor or cable will pick up energy from any existing electromagnetic field around it, and in the first case, may result in unwanted transmission of energy that may adversely affect nearby equipment or other parts of the same piece of equipment; and in the second case, unwanted pickup of noise that may mask the desired signal being carried by the cable.

There are particular cable designs that minimize electromagnetic pickup and transmission. Three of the principal design techniques are shielding, coaxial geometry, and twisted-pair geometry, for example. Shielding makes use of the electrical principle of the Faraday cage. The cable is encased for its entire length in foil or wire mesh. In some cables a grounded shield on cables operating at 2.5 kV or more gathers leakage current and capacitive current.

Coaxial design helps to further reduce low-frequency magnetic transmission and pickup. In this design, an inner conductor is surrounded by a tubular insulating layer, surrounded by a tubular conducting shield. Many coaxial cables also have an insulating outer sheath or jacket. The foil or mesh shield has a circular cross section and the inner conductor is exactly at its center. This causes the voltages induced by a magnetic field between the shield and the core conductor to consist of two nearly equal magnitudes which cancel each other.

Twisted pair cabling is a type of wiring in which two conductors of a single circuit are twisted together for the purposes of canceling out electromagnetic interference (EMI) from external sources. A twist rate (also called pitch of the twist, usually defined in twists per meter) makes up part of the specification for a given type of cable. Where nearby pairs have equal twist rates, the same conductors of the different pairs may repeatedly lie next to each other, partially undoing the benefits of differential mode. For this reason, it is commonly specified that, at least for cables containing small numbers of pairs, the twist rates must differ.

Twisted pair cables are often shielded in an attempt to prevent electromagnetic interference. Because the shielding is made of metal, it may also serve as a ground. Usually a shielded or a screened twisted pair cable has a special grounding wire added called a drain wire which is electrically connected to the shield or screen.

This shielding can be applied to individual pairs, or to the collection of pairs. When shielding is applied to the collection of pairs, this is referred to as screening. Shielding provides an electric conductive barrier to attenuate electromagnetic waves external to the shield and provides conduction path by which induced currents can be circulated and returned to the source, via ground reference connection.

A few examples of different field electrical cables can include: Category 1 cable (Cat 1) or voice-grade copper is a grade of unshielded twisted pair cabling designed for telephone communications; Cat6 (Category 6 cable) a standardized cable for Gigabit Ethernet and other network physical layers); An HDMI cables of about 5 meters (16 ft) can be manufactured to Category 1 specifications by using 28 AWG (0.081 $mm^2$) conductors or by 24 AWG (0.205 $mm^2$) conductors, an HDMI cable can reach lengths of up to 15 meters (49 ft).

Individual USB cables can run as long as 5 meters for 12 Mbps connections and 3 meters for 1.5 Mbps. With hubs, devices can be up to 30 meters away from the host, the USB 2.0 type cable has two wires that supply the power to the peripherals (−/+)5 volts (red color) and ground (brown) and a twisted pair (yellow and blue) of wires to carry the data. On the power wires, a computer can supply up to 500 milliamps of power at 5 volts; etc.

Although some cables and connectors have standard specification (parameters), others may have a custom tailored-made specification. Original equipment manufacturers (OEM) as well as automotive and defense industries often require custom cables and/or connectors for their equipment, for example. Tailoring may include any one, any combination, or all of the following different variables: lengths, insulation coloring, labels, sizes, diameter, etc. Further, the Cable Harnesses may be tailored. For example, a Cable Harness may have two or more connectors, connected by any topology and connection scheme according to a customer demand.

SUMMARY OF DISCLOSURE

The following acts may be performed when assembling a cable to a connector: stripping the cable from its main shield/screen; untwisting the twisted wires; revealing the conductive wire of each wire, placing and soldering the appropriate wire to its designated pad of the connector, and so on.

When cutting a cable (to a required length, for instance), its inner wires placement is random. Further, the cutting itself and the stripping of the outer shields/screen may cause some of the inner wires to protrude in different direction(s), such as in a random manner. Furthermore, when attempting to solder each wire to the appropriate pad of a connector, some of the inner wires may need to be first un-twisted, separated and guided (e.g., so that the appropriate inner wires are guided toward the relevant pads of the connector, such as, by detection of the color of the wire, for instance).

The coincidental and unpredictable manner of the inner wires placement when cutting a cable may cause a non-repetitive process even for similar cables. Thus, a smart entity intervention phase may be used during the cabling process (such as in between automatic acts of a production line).

Known techniques in the art for connecting cable to connectors use human operators. The human operators perform at least the following acts: strip a cable from its shield/screening; untwist twisted pair of wires and reveal their inner core, detect and place the relevant wire to its appropriate pad of connector.

Human operators may slow down the throughput of an assembly line. In this regard, lead time to market may be long, causing sometimes financial/client/tender loss. Thus, in order to avoid such losses some companies may then stock, for future use, a high storage of assembled connectors and cables. This may require storage place, redundant cost (if in the future will eventually not use); etc.

Human operators are usually based in countries in which the salary is low. Thus, the lead-time to market may even further increase due to the complexity of shipping the raw material and then the assembled material therefrom. Culture obstacles between different countries, language, and mentalities may further interfere in an assembly line of connectors and cables.

Different cable and connector types assembly may have different capacity requirements, thus may limit the ability to an accurately prediction of the manpower needed and time evaluation. In the long run, for a company, the above may raise the cost of the manufacturing, and interfere in competitive requirements, etc.

Further, human operators may be more prone to mistakes. Mistakes may include, but are not limited to: cutting the correct and accurate length of a cable/wire; wrong connection between wires and connector pins (pads); and so on.

Some of the inventions or leading edge of a product is in the cables and/or connector of the product. Thus, a company may prefer having the assembly of the connectors and cables be done at its offices and not outsourced to a contractor.

The above-described deficiencies in common assembly connector and cables do not intend to limit the scope of the inventive concepts in any manner. They are merely presented for illustrating an existing situation.

Among other things, the present disclosure provides a novel system, apparatus and method for an automatic-robotic-system-for-cable assembly (ARSFCA). An exemplary embodiment of an automatic-robotic-system-for-cable assembly may automatically do one, some, all or any combination (including the listed combination) of the following: obtain a cable; strip the cable; detect and/or distinguish between the different inner wires of the stripped cable; unwind (e.g., untwist) the one or more inner wires of the cable; strip and cut a plurality of the inner wires.

Next, the automatic-robotic-system-for-cable assembly (ARSFCA) may coat one, some, or all of the plurality of inner wires with one or more coatings. Examples of coating may be: flux, tin, a combination of them and so on. The automatic-robotic-system-for-cable assembly may automatically guide each inner wire to an appropriate pad of a relevant connector and electrically connect the inner wires to the pads of the connector. In one embodiment, the electrical connection comprises soldering the inner wires to the pads of the connector. In other embodiments, the association of the wire with the connector's pad may be by crimping.

An exemplary embodiment of an automatic-robotic-system-for-cable assembly may comprise: a controller; an inner-wire detector; a robotic inner-wire placer; a carrier; an automatic wire handler (cutter/stripper and dipper, for example); an inner-wire guider; an automatic connector provider; and a soldering unit.

The inner-wire detector and robotic inner-wire placer may detect the type of wire and its inner wires. The detection may be by one or different sensors. As a non-limiting example, a sensor may include a camera and an imager processor. The camera may be a video camera and/or a still-picture camera (taking still pictures) of the cable's end. The image processor may obtain the images from the camera and process the image. The image processor may detect one or more of the inner wires and its placement in a three dimension space, for example. The detection of an inner wire may be according one or more aspects of the inner wire. In one instance, the detection of the inner wire may be based on the color of the inner wire.

Accordingly, commands may be sent, from the controller to the robotic inner-wire placer. Each detected inner wire may be automatically untwisted and placed by the robotic inner-wire placer in a proper place on the carrier. The carrier may have a plurality of hooks, for instance. Each hook may grasp an obtained inner wire.

Next, the carrier may automatically transfer the inner wires toward and/or through one or more modules of the automatic-robotic-system-for-cable assembly (ARSFCA). For instance, the carrier may transfer the inner wires through automatic wire handler, which may further cut to a required length and strip each inner wire. The automatic wire handler may further coat the revealed edges of the inner wires in a tin or flux coating. In some embodiments, the stripped edges may be coated by dipping the ends of the inner wire in a bath with the coating material, for example.

Next, the carrier may transfer the inner wires toward and/or through the guider to the relevant pads of the connector to which they are to be soldered to, by the soldering unit. Wherein the connector may be brought by the automatic connector provider. The guider may guide one or more of the inner wires toward the relevant pad of the connector.

As a non-limiting example the guider may comprise a plurality of channels through which the inner wires pass through toward the relevant pads. In some embodiments, for each type of connector a different guider may be used. In other embodiments, the guider may be automatically adjustable according to the connector used.

The soldering unit may solder each inner wire to the relevant pad of the connector using one or more soldering iron together with tin, for instance. In other embodiments, it may use one large solder iron covering all the pads, to reduce complexity and costs.

Advantageously, the automatic-robotic-system-for-cable assembly (ARSFCA) may eliminate the need for a human operator, since the ARSFCA has robotic and automatic elements. The ARSFCA inputs may be raw materials. The ARSFCA output may be a cable connected, at least at one of its ends, to a connector.

Furthermore, the ARSFCA system can include a station for cable harnesses routing by using a robotic operator that will fixate the harnesses on a routing board.

For High mix low volume, the ARSFCA system may include a station for positioning wires (using soldering or crimp) in to specific connectors. The software may enable definition of a specific location where to place each wire according to a specific connector shape.

These and other aspects of the disclosure will be apparent in view of the attached figures and detailed description. The foregoing summary is not intended to summarize each potential embodiment or every aspect of the present disclosure, and other features and advantages of the present disclosure will become apparent upon reading the following detailed description of the embodiments with the accompanying drawings and appended claims.

Furthermore, although specific embodiments are described in detail to illustrate the inventive concepts to a person of ordinary skill in the art, such embodiments are susceptible to various modifications and alternative forms. Accordingly, the figures and written description are not intended to limit the scope of the inventive concepts in any manner.

BRIEF DESCRIPTION OF THE DRAWINGS

Few examples of embodiments of the present disclosure will be understood and appreciated more fully from the following detailed description, taken in conjunction with the drawings in which:

FIGS. 2*a-c* are schematic illustrations of simplified block diagrams with relevant elements of an examples of connectors and their pins;

DETAILED DESCRIPTION OF EXEMPLARY EMBODIMENTS

Turning now to the figures in which like numerals and/or labels represent like elements throughout the several views, exemplary embodiments of the present disclosure are described. For convenience, only some elements of the same group may be labeled with numerals. The purpose of the drawings is to describe exemplary embodiments and is not for production purpose. Therefore, features shown in the figures are for illustration purposes only and are not necessarily drawn to-scale and were chosen only for convenience and clarity of presentation.

Figure 1A:
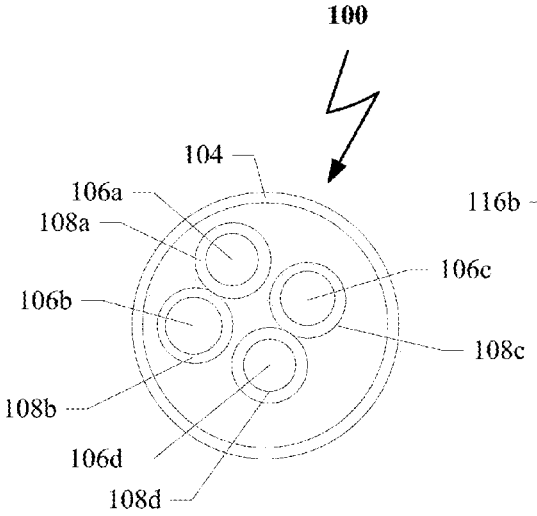
FIGS. 1*a-e* are schematic illustrations of simplified block diagrams with relevant elements of an examples of cables and their inner wires.

FIG. 1*a* schematically illustrates a simplified portion of a block diagram with relevant elements of an inside view of an example of an unshielded-twisted pair (UTP) cable 100. The UTP cable 100 may include a plurality of unshielded twisted pair wires. Each wire 106*a-d* may have a shield 108*a-d*. A pair of unshielded twisted wires may be: 106*a* wire twisted with 106*b* wire; 106*c* wire twisted with 106*d*, for example. UTP cable 100 may include a shield/screen sleeve 104 along its surrounding.

Figure 1B:
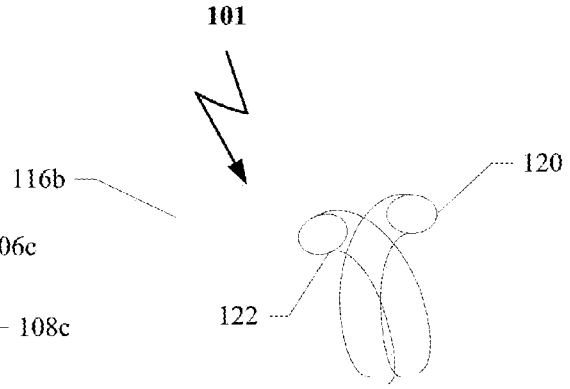

FIG. 1*b* schematically illustrates a simplified diagram with relevant elements of an example of a twisted pair wire 101. The twisted pair wire 101 may include two wires: wire 120 and wire 122. Wires 120 and 122 may be twisted one along the other in a twist rate (also called pitch of the twist, usually defined in twists per meter).

Figure 1C:
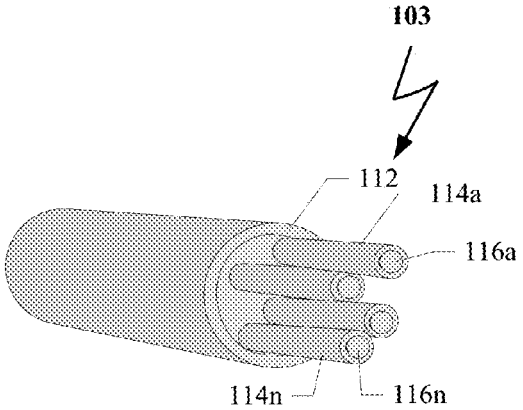

FIG. 1*c* schematically illustrates a simplified portion of a block diagram with relevant elements of an example of a cable 103. Cable 103 may be similar to cable 100 (FIG. 1*a*), for instance. The cable 103 is partially stripped from it shielding/screening sleeve 112 thus exposing a plurality of inner wires 116*a-n*. Each inner wire 116*a-n* is shielded by a shielding sleeve 114*a-n*.

Figure 1D:
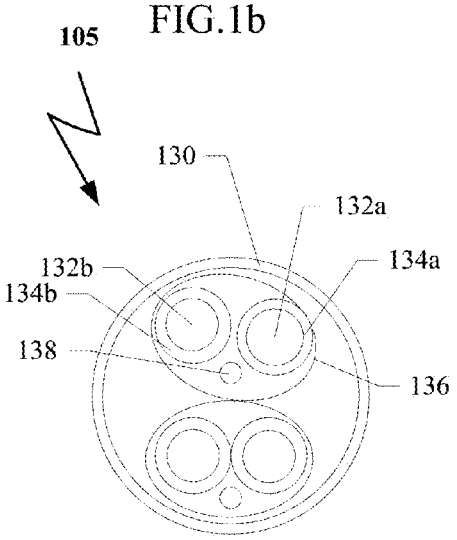

FIG. 1*d* schematically illustrates a simplified portion of a block diagram with relevant elements of an inside view of an example of a shielded twisted pair (STP) cable 105. STP cable 105 may include a shielding/screening sleeve 103 and a plurality of shielded twisted pair inner wires. An inner wire 132*a* shielded by a shielding sleeve 134*a* may be twisted with an inner wire 132*b* shielded by a shielding sleeve 134*b*. Together twisted inner wires 132*a-b* may be further shielded with a shielding sleeve 136. In some embodiments the twisted shielded pair may further comprise an additional inner wire 138. Inner wire 138 may be a drain wire, for instance.

Figure 1E:
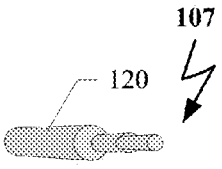

FIG. 1*e* schematically illustrates a simplified portion of a block diagram with relevant elements of an example of a coaxial cable 107. The coaxial cable 107 may include a center core 140, in the center of a dielectric insulation 142 further shielded by a metallic shield, for example.

FIG. 2*a* schematically illustrates a simplified portion of a block diagram with relevant elements of an example of a USB connector type A 202. USB connector type A 202 may have a plurality of pins 204*a-d* at the surface of one of its sides.

FIG. 2*b* schematically illustrates a simplified portion of a block diagram with relevant elements of an example of a USB connector type B 210. USB connector type B 201 may have 2 pins 212-*b* on the surface of one of its side and pins 212*c-d* on the surface of the contrary side, for example.

FIG. 2*c* schematically illustrates a simplified USB connector's pin chart. Pin 1 named VCC may be pin 204*a* of FIG. 2*a*, for instance. Pin 1 may need to be connected to a red inner wire of a USB cable for a 5 DC voltage. Pin 2 named D− may be pin 204*b* of FIG. 2*a*, for instance. Pin 2 may need to be connected to a white inner wire of a USB cable for differential data transfer. Pin 3 named D+ may be pin 204*c* of FIG. 2*a*, for instance. Pin 3 may need to be connected to a green inner wire of a USB cable for differential data transfer. Pin 4 named GND may be pin 204*d* of FIG. 2*a*, for instance. Pin 4 may need to be connected by a green inner wire of a USB cable to ground (zero voltage).

Figure 3:
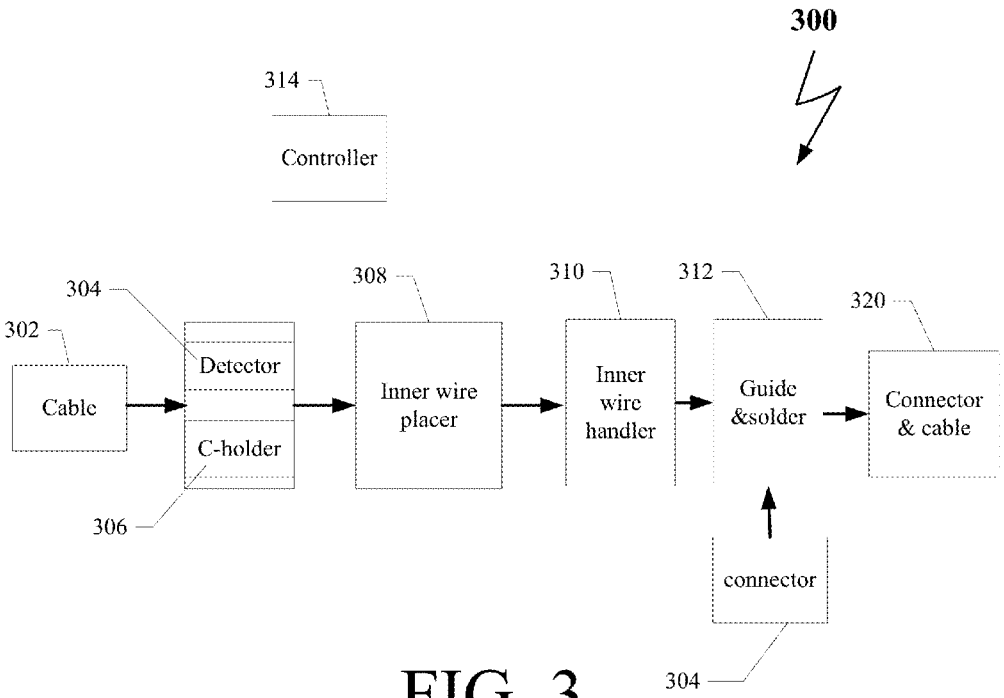
FIG. 3 is schematic illustrations of simplified block diagrams with relevant elements of an examples of an automatic-robotic-system-for-cable assembly (ARSFCA), according to exemplary teaching of the present disclosure.

FIG. 3 schematically illustrates a simplified portion of a block diagram with relevant elements of an example of an embodiment of an automatic-robotic-system-for-cable assembly (ARSFCA) 300. It should be appreciated that the illustrated blocks in FIG. 3, as well as other diagrams throughout the application, are for illustration purposes, such as to show categories of functionality that may or may not be included in various embodiments of an ARSFCA but are not necessarily separate functional systems or devices. In this regard, the functional blocks may be represented in separate devices, or may be represented in fewer devices, or may be represented in a single device. Further, the functional separations illustrated are not for production but rather for illustration.

A cable 302 and a connector 304 may be input to the ARSFCA 300. Input may be automatically and/or via an operator. In some embodiments, the ARSFCA 300 may include a detector 304 and a cable-holder 306. The detector 304 may include one or more sensors. The sensors may be of various types such as, but not limited to: cameras, optical sensors, ultrasound sensors, a combination of them as well as other types.

In some embodiments, the detector 304 may detect the input cable 302 type. The detection may be according to different criteria: color, thickness, marking on the cable, etc. In this regard, the sensor may sense at least a part of the input cable (e.g., optically sense the input cable, such as inputting an image of the input cable), analyze the sensed input (e.g., analyze the image to determine the criteria, such as color, thickness, etc.), and determine the type (e.g., use a table that correlates the determined criteria to the type). In another embodiment, an operator may input the type of cable and connector that will be used. The cable-holder 306 may obtain and hold the input cable 302.

In some embodiments, the detector and cable-holder 306 may include a cable stripper that may strip the edge of the input cable 302 from its first screening sleeve. In other embodiments, the input cable's 302 edge may already be stripped from the first screening sleeve before entering the ARSFCA 300. The cable-holder may further include a plurality of hooks.

The detector 304 may detect and distinguish between the different inner-wires of the stripped-edge cable 306. As a non-limiting example, the distinction may be done by the colors and/or labels of the shielding of the inner-wires. For example, the stripped-edge cable 306 may be imaged, and then analyzed to determine the colors and/or labels of the shielding of the inner-wires. The detected information on the detected inner-wires may be sent toward a controller 314. Example of detected information may be the detected place in space of one or more of the inner wires (three dimension place in space, for instance).

According to commands obtained from the controller 314, an inner-wire placer 308 may get one or more of the detected inner wires. In some embodiments, the inner-wire placer 308 may be a robotic hand, for example. The inner-wire placer 308 may: get an inner wire of the input cable 302; may partially untwist the inner wire around the other inner wires. Next the inner-wire placer 308 may place the partially untwisted inner wire on one of the cable-holder's 306 hook.

The chosen hook may be according to different criteria. An example of criteria may be the placement of a pin on an input connector that the inner wire will be soldered to.

After each inner wire has been placed on the relevant hook of the cable-holder 306, one or more of the inner wires may be treated by an inner-wire handler 310. The inner-wire handler 310 may: partially strip one or more of the inner wires from its shield sleeve; may cut the edge of the inner wire to a certain length; and coat the edge of the inner wire with coating substance. Coating substances may include, but are limited to: flux, tin, a combination of them, etc.

Next, a guide and solder 312 may guide each one or more of the inner wires toward the appropriate pad of the connector 304. A solder iron together with tin may solder each inner wire to its relevant pad (pin) of the connector 304. Thus, a connected cable and connector 312 may be output from the ARSFCA 300.

In some embodiments, the automatic-robotic-system-for-cable assembly (ARSFCA) 300 may include other units (not shown in the drawing). Other embodiments of automatic-robotic-system-for-cable assembly (ARSFCA) 300 may not include all the units described in FIG. 3. In some embodiments of an automatic-robotic-system-for-cable assembly (ARSFCA) 300 a few similar units may work in parallel, such as a bottle neck unit, and so on.

Figure 4A:
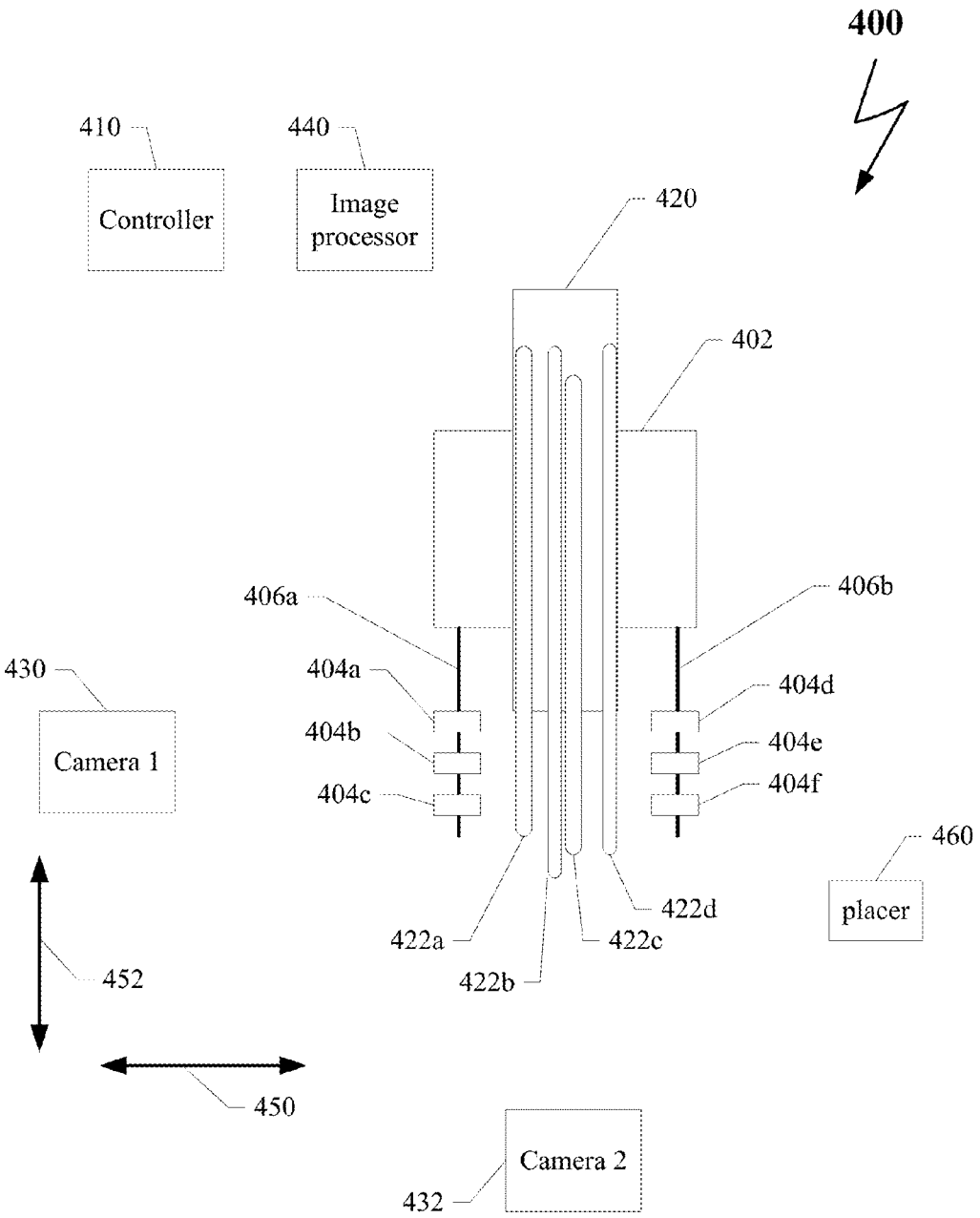
FIG. 4*a-e* is schematic illustrations of simplified block diagrams with relevant elements of an examples of a cable holder, according to exemplary teaching of the present disclosure.

FIG. 4*a* schematically illustrates a simplified portion of a block diagram with relevant elements of an example of an embodiment of an automatic-robotic-system-for-cable assembly's cable-holder 400 together with a plurality of detectors and an inner wire placer. A cable holder 402 may grip a cable 420. The cable holder 402 may be of one of various types, such as: a tube-like shape with an adjustable diameter; a clip-like shape gripper (not shown in drawing); etc. The cable 420 may be partially stripped from its shielding/screening sleeve, and a plurality of inner wires 422*a-d* may protrude out of the cable 420.

The cable holder 402 may include a plurality of hooks 404*a-f* associated to axis 406*a* or 406*b*. One or more of cameras 430 and 432 may video or take still picture(s) of the exposed and protruded inner wires 422*a-d*. In some embodiments, one or more of the cameras 430 and/or 432 may be in movement. The movement may be according to commands obtained from a controller 410, for example. Movement of cameras 430 and/or 432 may be similar to arrows 450 and 452 and/or a combination of them, for instance.

The images from the cameras may be obtained by an image processor 440. The image processor may obtain the images from the cameras and accordingly determine the placement of each inner wire 422*a-d* in space. The placement of each inner wire 422*a-d* may be expressed in x-y-z axis, for instance. The information on the placement of each inner wire may be obtained by the controller.

According to commands received from the controller 410, an inner-wire placer 460 may get one of the inner wires 422*a-d* and associate the inner wire to the relevant hook 404*a-f*. The commands may include: placement of the inner wire in space; the relevant hook to associate the inner wire to; etc.

Figure 4B:
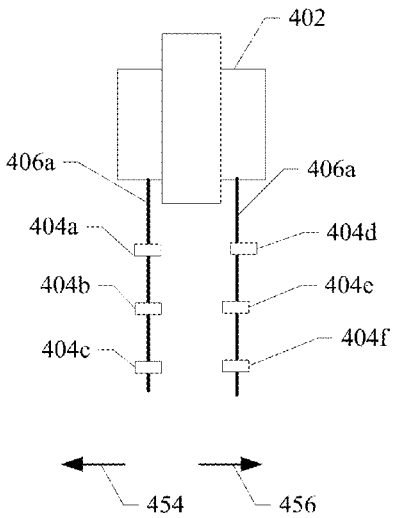
Figure 4C:
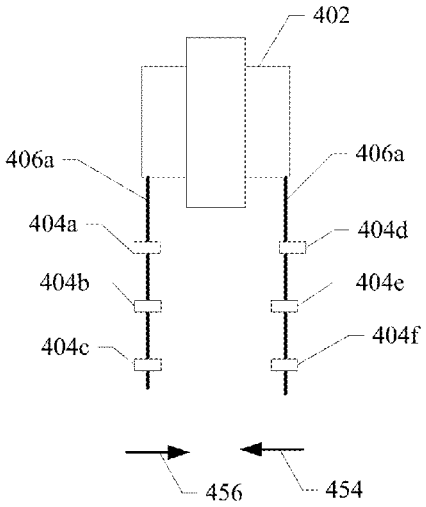

FIG. 4*b* and FIG. 4*c* schematically illustrate a simplified portion of a block diagram with relevant elements of an example of an embodiment of a cable-holder's 402 axis 406*a-b* placements and movement. In some embodiments, each of the axis 406*a* and/or 406*b* may move in a directions similar to arrows 454 or 456. The movement of the axis 406*a-b* may be according to commands obtained from a controller. The movement and placement of the axis 406*a-b* may be before and/or while inner wires of a cable are associated to the axis 406*a-b*.

Figure 4D:
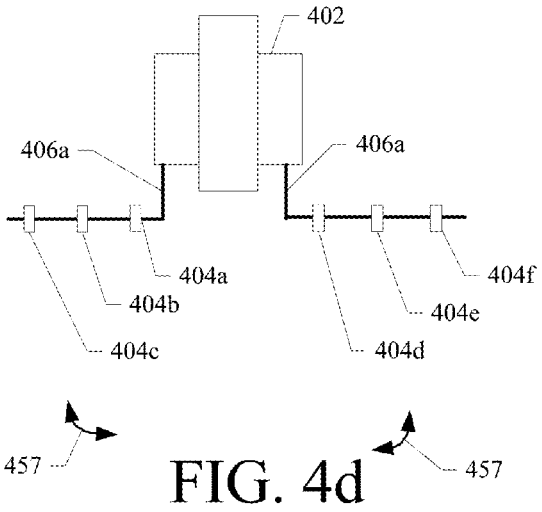

FIG. 4*d* schematically illustrates a simplified portion of a block diagram with relevant elements of an example of an embodiment of a cable-holder's 402 axis 406*a-b* placements and movement. In some embodiments each of the axis 406*a* and/or 406*b* may move in a directions similar to arrows 457. The movement of the axis 406*a-b* may be according to commands obtained from a controller. The movement and placement of the axis 406*a-b* may be before and/or while inner wires of a cable are associated to the axis 406*a-b*.

Figure 4E:
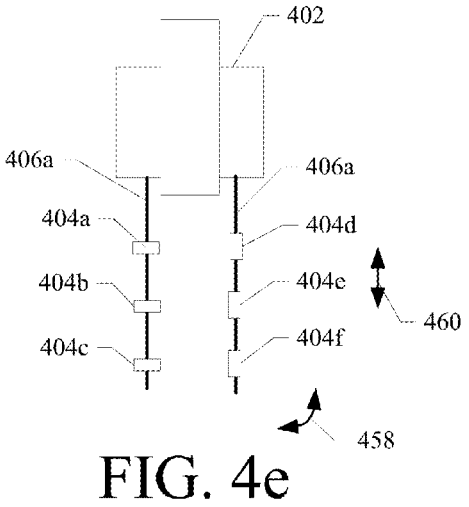

FIG. 4*e* schematically illustrates a simplified portion of a block diagram with relevant elements of an example of an embodiment of a cable-holder's 402 hooks 404*a-f* placements and movement. In some embodiments each of the hooks 404*a-f* may move in a direction similar to arrow 458. The movement of the hooks 404*a-f* may be according to commands obtained from a controller. The movement and placement of the hooks 404*a-f* may be before and/or while inner wires of a cable are associated to the hooks 404*a-f*. The hooks may further move along the axis 406*a* or 406*b* in direction similar to arrow 460.

Figure 5A:
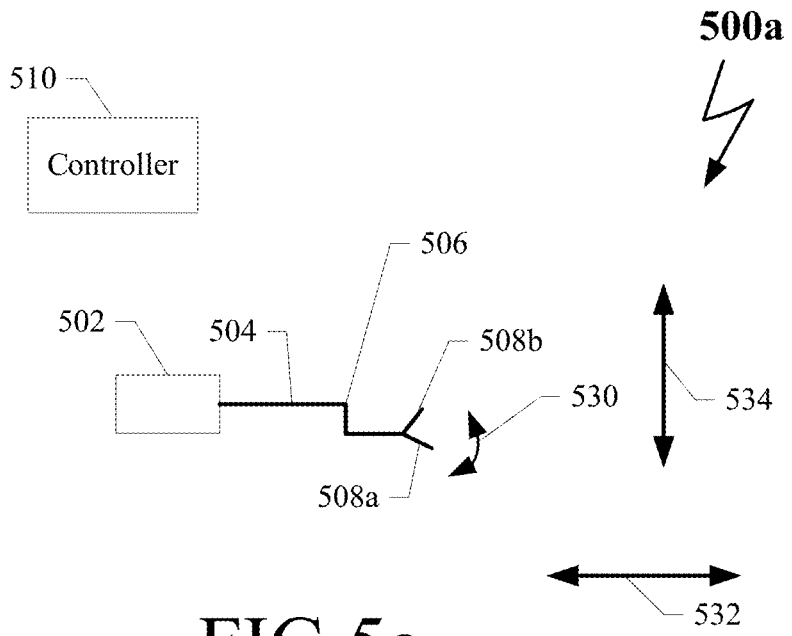
FIG. 5*a-b* is schematic illustrations of simplified block diagrams with relevant elements of an examples of an inner-wire placer, according to exemplary teaching of the present disclosure.

FIG. 5*a* schematically illustrates a simplified portion of a block diagram with relevant elements of an example of an embodiment of an inner-wire placer 500*a*. The inner-wire placer 500*a* may include: a motor 502, a gripper 508*a-b*, and an arm 506. The inner-wire placer 500*a* may receive commands from a controller 510. The commands may assist in gripping an inner wire and placing on the correct hook of a cable holder, for example. The arm of 506 may have a plurality of axis that may enable it to bend in different directions.

The gripper 508*a-b* of the inner-wire placer 500*a* may have a clip-like shape, for instance. The clip-like shape may open and close in direction similar to arrow 530, according to commands gotten from the controller 510. The motor 502 may move the inner-wire placer 500*a* in a different direction according to controller 510 commands, such as a direction similar to arrows 534, 532, and/or a combination of them.

Figure 5B:
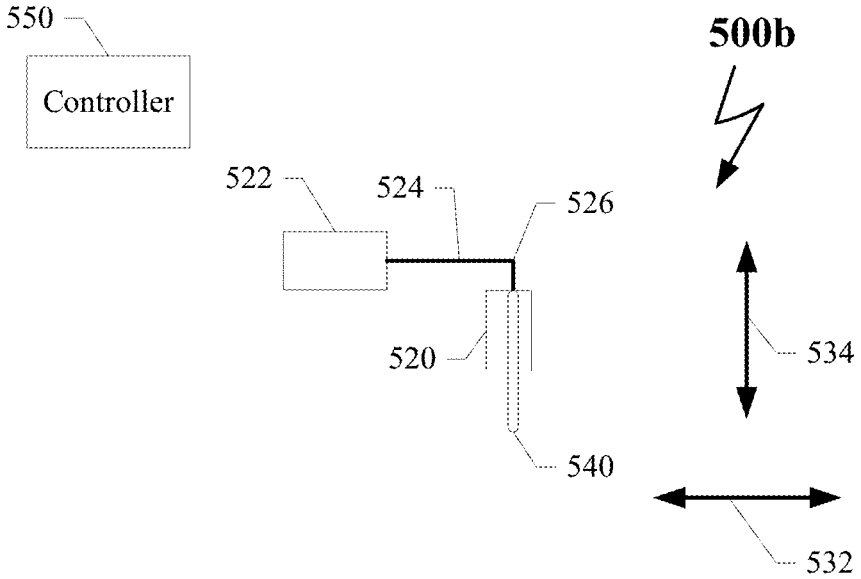

FIG. 5*b* schematically illustrates a simplified portion of a block diagram with relevant elements of an example of an embodiment of an inner-wire placer 500*b*. The inner-wire placer 500*b* may include: a motor 522 a gripper 520, and an arm 526. The inner-wire placer 500*b* may get commands from a controller 550. The commands may assist in gripping an inner wire and placing on the correct hook of a cable holder, for example. The arm of 526 may have a plurality of axes that may enable it to bend in one or more different directions.

The motor 502 may move the inner-wire placer 500*a* in a different direction according to controller 510 commands, such as directions similar to arrows 534, 532, and/or a combination of them. The gripper 520 of the inner-wire placer 500*b* may have a cup-like shape, for instance. The cup-like shape may wrap an inner wire 540 and guide it toward the relevant hook of a cable holder (not shown in drawing). The cup-like shape gripper 520 may be a simple cup and/or may have additional attributes. Examples of attributes may be: vacuum, adjustable diameter, etc.

Figure 6A:
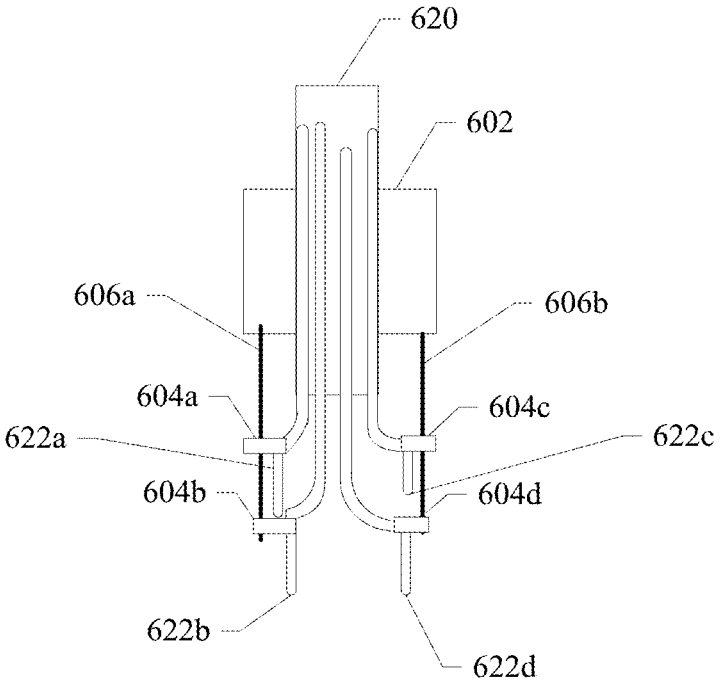
FIG. 6*a-b* is schematic illustrations of simplified block diagrams with relevant elements of an examples of a cable holder with inner wires associated to it, according to exemplary teaching of the present disclosure.

FIG. 6*a* schematically illustrates a simplified portion of a block diagram with relevant elements of an example of an embodiment of a cable-holder 602 holding a cable 620. The inner wires 622*a-d* of the cable 620 are associated to the cable holder's 602 hooks 604*a-d*.

Figure 6B:
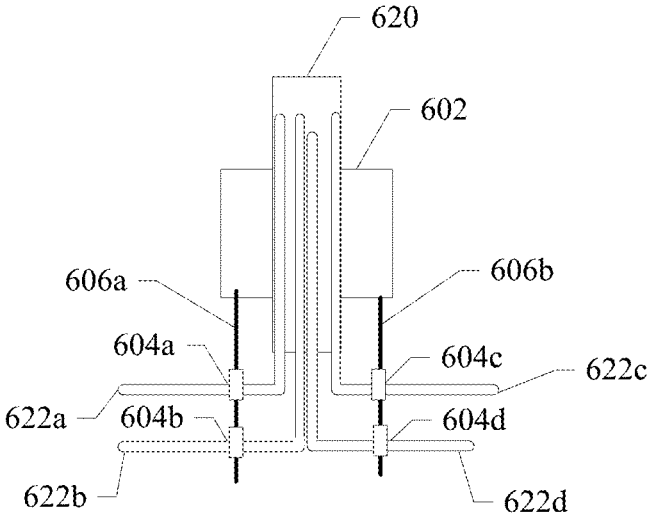

FIG. 6*b* schematically illustrates a simplified portion of a block diagram with relevant elements of an example of an embodiment of a cable-holder 602 holding a cable 620. The inner wires 622*a-d* of the cable 620 are associated to the cable holder's 602 hooks 604*a-d*. The hooks 604*a-d* may be rotated in 90 degree along axis 606*a* or 606*b* in comparison to the placement of the hooks 604*a-d* in FIG. 6*a*, causing the inner wires 622*a-d* to protrude perpendicular to the axis 606*a* or 606*b*.

Figure 7A:
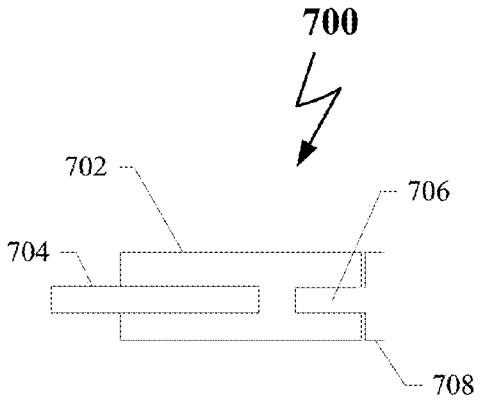
FIG. 7*a-d* is schematic illustrations of simplified block diagrams with relevant elements of an examples of a cable holder's hook, according to exemplary teaching of the present disclosure.

FIG. 7*a* schematically illustrates a simplified portion of a block diagram with relevant elements of an example of an embodiment of a cable-holder's hook 700. The hook 700 may include: a hollow housing 702, a piston 704, and a movable gripper 706. The movable gripper 706 may have a griping mechanism 708 protruding from the surface of the hook's housing 702.

Figure 7B:
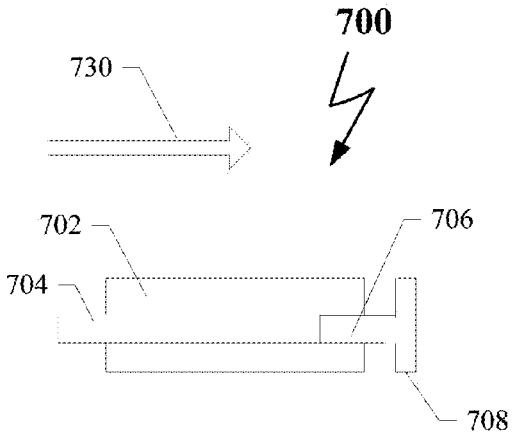

FIG. 7*b* schematically illustrates the embodiment of a cable-holder's hook 700 of FIG. 7*a*, wherein the piston has moved according to commands gotten from a controller, for example. The movement of the piston is in direction similar to arrow 730. The piston may push the movable gripper 706 to move as well in direction similar to arrow 730. Thus creating a gap between the griping mechanism 708 and the surface of the hollow housing 702.

Figure 7C:
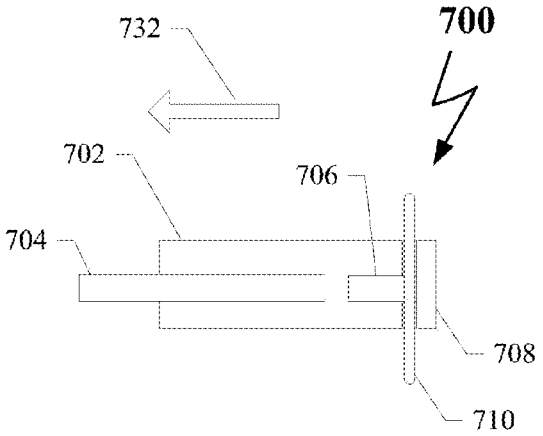

FIG. 7*c* schematically illustrates the embodiment of a cable-holder's hook 700 of FIGS. 7*a* and 7*b*, wherein an inner wire 710 of a cable (not shown in the drawing) has been placed between the griping mechanism 708 and the surface of the hollow housing 702. A spring mechanism (not shown in the drawing) may return the griping mechanism 708 toward the surface of the hollow housing 702 in a direction similar to arrow 732. Thus the inner wire 710 may be held tightly to the hook 700.

Figure 7D:
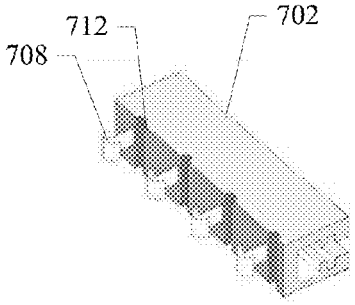

FIG. 7*d* schematically illustrates the embodiment of a cable-holder's hook 700 of FIG. 7*a-c*, wherein the surface of the hollow housing 702 may further include a dent 712. Into the dent, the inner wire 710 may be placed. Advantageously, the inner wire 710 may be even further held tightly/securely in place to the hook 700 by the griping mechanism 708 when placed in the dent 712.

Figure 8A:
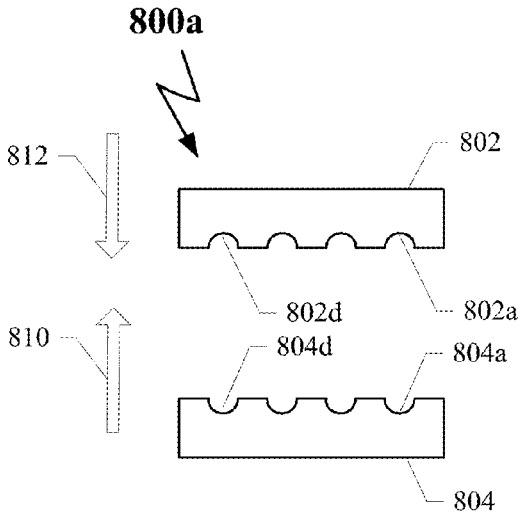
FIG. 8*a-d* is schematic illustrations of simplified block diagrams with relevant elements of an examples of a stripping and/or cutting blades, according to exemplary teaching of the present disclosure.

FIG. 8*a* schematically illustrates a simplified portion of a block diagram with relevant elements of an example of an embodiment of stripping and/or cutting blades 800*a*. The stripping and/or cutting blades 800*a* may be used to strip the inner wires from their shielding sleeve. The stripping and/or cutting blades 800*a* may further be used to cut the inner wires to a required length, for example.

The stripping and/or cutting blades 800*a* may include one or more counter blades, such as two counter blades 802 and 804. Each counter blade may include a plurality of structural blades 802*a-d* and 804*a-d*. The spacing between the structural blades 802*a-d* and 804*a-d* may be even. In other embodiments, the spacing between the structural blades 802*a-d* and 804*a-d* may differ. The space between the hooks in a cable-holder may be adjusted to be similar to the spacing between the structural blades 802*a-d* and 804*a-d*. The parameters of the structural blades 802*a-d* and 804*a-d* may be similar between all structural blades 802*a-d*. Example of parameters may be, but not limited to: shape, with, height, thickness, the sharpness, etc.

A controller may receive information regarding the placing of the inner wires edge in accordance to the blade's structural blades 802*a-d*. The controller may command the hook to correct placement of the inner wires in order to make sure that the inner wire is stripped and/or cut to the correct length.

Once all the inner wires have been placed in a required length between the counter blades 802 and 804, the counter blades 802 and 804 may move one toward the other in a direction similar to arrows 812 and 810. In some embodiments, one of the counter blades 802 or 804 may stay in place and another of the counter blades 802 or 804 may move toward it.

The distance left between the counter blades 802 and 804 may determine if a cutting operation is performed or a stripping operation is performed. If a stripping operation is performed, the controller may further command the hook and/or the counter blades to move in a stripping motion as well.

Figure 8B:
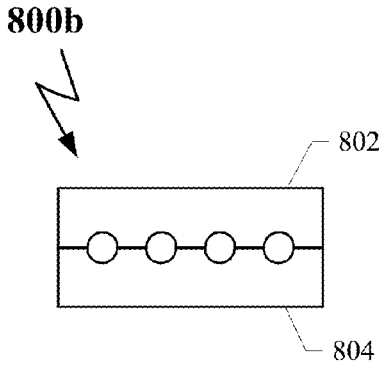

FIG. 8*b* schematically illustrates a simplified portion of a block diagram with relevant elements of an example of an embodiment of a stripping and/or cutting blades 800*b* similar to 800*a* of FIG. 8*a* when the counter blades 802 and 804 closed together.

Figure 8C:
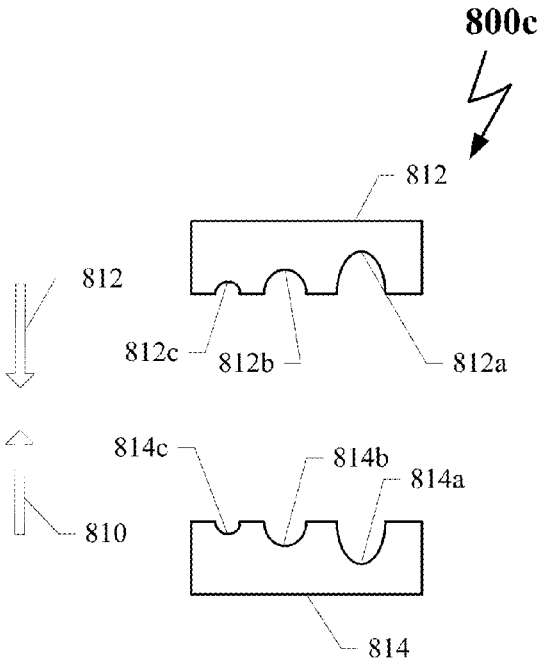

FIG. 8*c* schematically illustrates a simplified portion of a block diagram with relevant elements of an example of an embodiment of a stripping and/or cutting blades 800*c* similar in operation to stripping and/or cutting blades 800*a* of FIG. 8*a*. The stripping and/or cutting blade's 800*c* may have different parameters to the different structural blades 812*a-d* and 814*a-d*. For example, the diameter of each structural blades 812*a-d* and 814*a-d* may differ from the other.

Figure 8D:
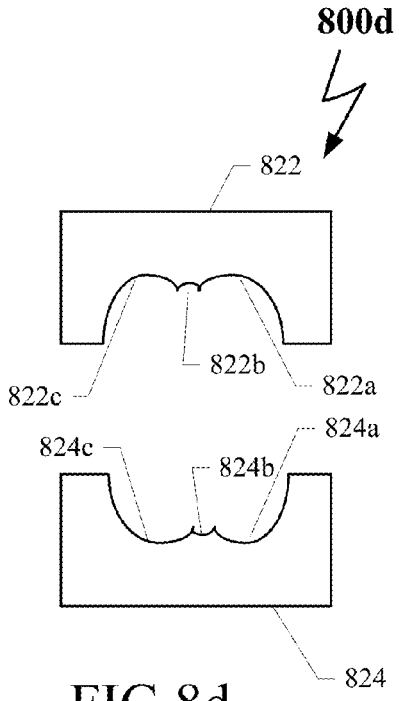

FIG. 8*d* schematically illustrates a simplified portion of a block diagram with relevant elements of an example of an embodiment of a stripping and/or cutting blades 800*d* similar in operation to stripping and/or cutting blades 800*a* of FIG. 8*a*. The stripping and/or cutting blade's 800*d* may have a shape for stripping and/or cutting. Two shielded twisted pair with a grounding wire. The Two shielded twisted pair inner wires may be inserted through 822*c* together with 824*c* and 822*a* together with 824*a* respectively, and the grounding wire may be inserted between 822*b* and 824*b*.

Figure 9:
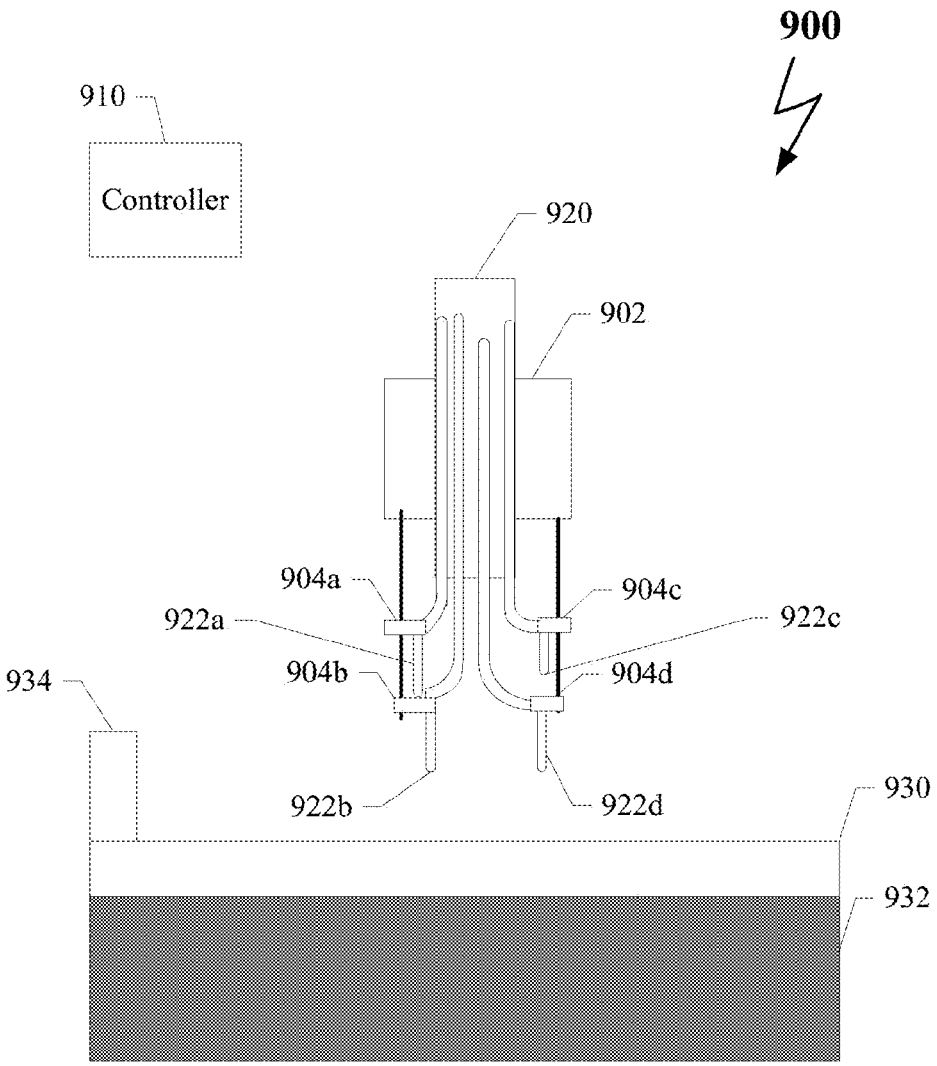
FIG. 9 is schematic illustrations of simplified block diagrams with relevant elements of an examples of an inner wire coating system, according to exemplary teaching of the present disclosure.

FIG. 9 schematically illustrates a simplified portion of a block diagram with relevant elements of an example of an embodiment of a coating mechanism 900. A cable holder 902 may carry a cable 920. The cable's 920 inner wires 922*a-d* may be held by the hooks 904*a-d* respectively. The hooks may be placed such that the inner wires edges are direct toward a bath 930. The bath 930 may include different coating substances 932. Coating substances such as, but not limited to: tin, flax, a combination of them as well as other substances.

The bath 930 may include a heating element (not shown in drawing) and a temperature measurements (such as a temperature sensor) and feedback 934, to control the temperature of the coating substance 932. A controller 910 may control the hooks and the cable holder, together with the heating element. The controller 910 may direct the cable holder to dip the edges of the inner wires when the temperature is right. Further the controller 910 may command the cable-holder 902 the depth to dip the inner wires. The controller 910 may further command the cable holder 902 to output the inner wires from the bath, after a pre-defined time has passed.

Figure 10A:
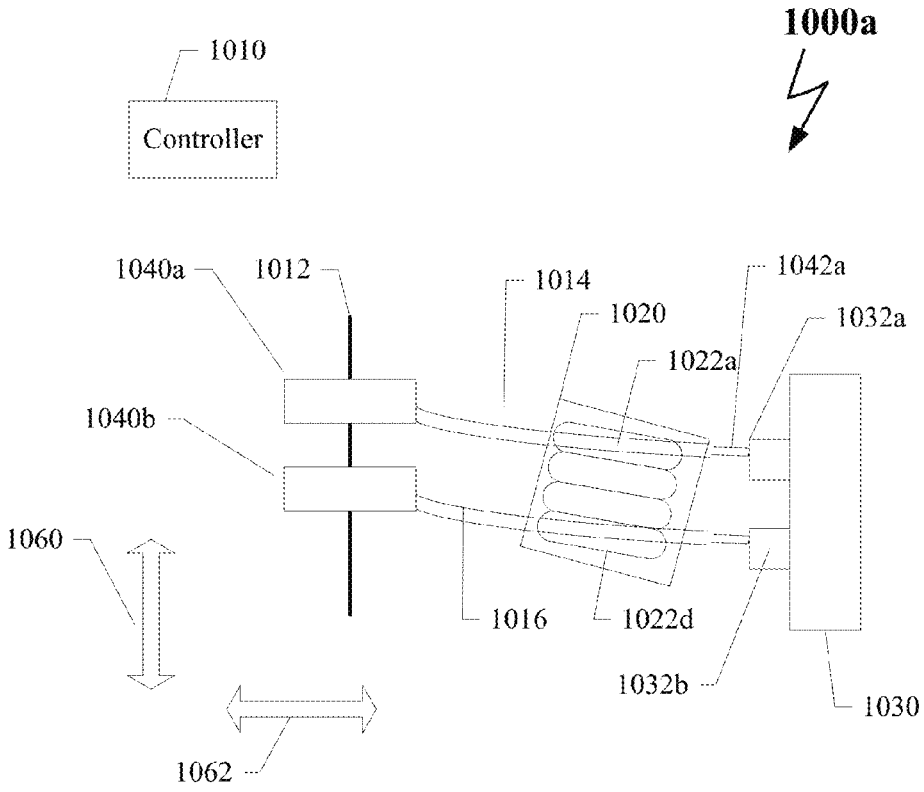
FIG. 10*a-b* is schematic illustrations of simplified block diagrams with relevant elements of an examples of an inner wire guider, according to exemplary teaching of the present disclosure.

FIG. 10*a* schematically illustrates a simplified portion of a block diagram with relevant elements of an example of an embodiment of an inner-wire guiding 1000*a*. The inner-wire guiding 1000*a* may include an inner-wire guider 1020. Then, inner-wire guider 1020 may be a movable substrate comprising a plurality of inner channels 1022*a-d*. The inner channels 1022*a-d* may have a constant shape/placement and/or an adjustable shape/placement.

The shape/placement of the inner channels 1022*a-d* may be according to the inner wires of a cable that needs to be connected to a connector 1030, and/or according to the placement of the pads 1032*a-b* of the connector 1030 and/or a combination of them.

A plurality of cable holder's hooks 1040*a-b* may hold the inner wires 1014 and 1016. In some embodiments, the cable holder may guide the inner wires toward and through the inner-wire guiding 1000. In other embodiments, the inner-wire guiding 1000 may move toward the inner wires with the hooks and guide them toward and through the channels 1022*a-d* respectively.

Once the inner wires 1014 and 1016 edges have passed through the inner-wire guider channels 1022*a-d* than a connector 1030 may be connected to the inner wires. Each connector's pad 1032*a-b* may be associated to the relevant inner wire 1014*a-b*. The association may be by crimping or soldering, for example.

Figure 10B:
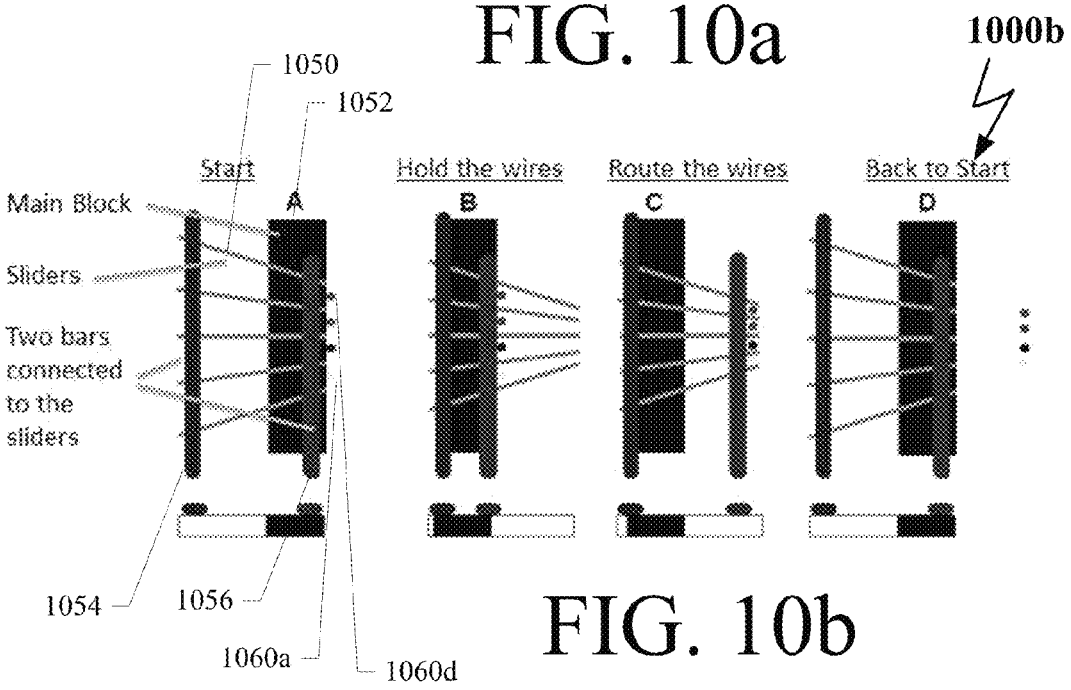

FIG. 10*b* schematically illustrates a simplified portion of a block diagram with relevant elements of an example of another embodiment of an inner-wire guiding 1000*b*. The inner-wire guiding 1000*b* may include a main block 1052 a plurality of sliders 1050*a-n*; two bars 1054 and 1056 through which the sliders are connected and passed through sliders.

At stage one: A plurality of inner wire 1060*a-d* may be associated to the main block 1052. At stage two: the two inner wires are held by the bar 1056. At stage three: the bars 1056 separate and guide the inner wires 1060*a-d* together with the sliders 1050*a-n* toward the required pads of connector (not shown in the drawing). Once the pads are reached, stage four, the wires are associated to the pads of the connector and the bar 1056 and sliders 1050*a-n* detach from the inner wires 1060*a-d*.

FIG. 10*b* schematically illustrates a simplified portion of a flowchart with relevant acts of an example of an embodiment of an automatic-robotic-system-for-cable assembly (ARSFCA) method 1100. ARSFCA method 1100 may initialize 1104 resources. Resources such as, but not limited to: timers, counters, etc. ARSFCA method 1100 may get information on cable and connector that is about to be connected via the ARSFCA process 1100. The information may be input be an operator, for example.

Then, ARSFCA process 1100 may wait 1108 for a cable and/or connector entry to a ARSFCA system. Once the cable and/or connector has entered, the ARSFCA method 1100 may strip 1108 the shielding/screening sleeve and/or isolation sleeve of the cable. Next, a loop may begin 1110 for each inner wire twisted pair, for example.

The ARSFCA method 1100 may detect 1112 an inner wire. Grasp 1114 the detected inner wire. Untwist 1114 the inner wire around the bundle of inner wires of the cable (in clockwise direction, for instance). Place 1114 the inner wire on a relevant hook of a cable holder. If at 1116, another inner wire is required to be handled then ARSFCA method 1100 returns to act 1112. If at 1116 another inner wire does not need to be handled, then ARSFCA method 1100 may proceed to act 1120 FIG. 11*b*.

Figure 11A:
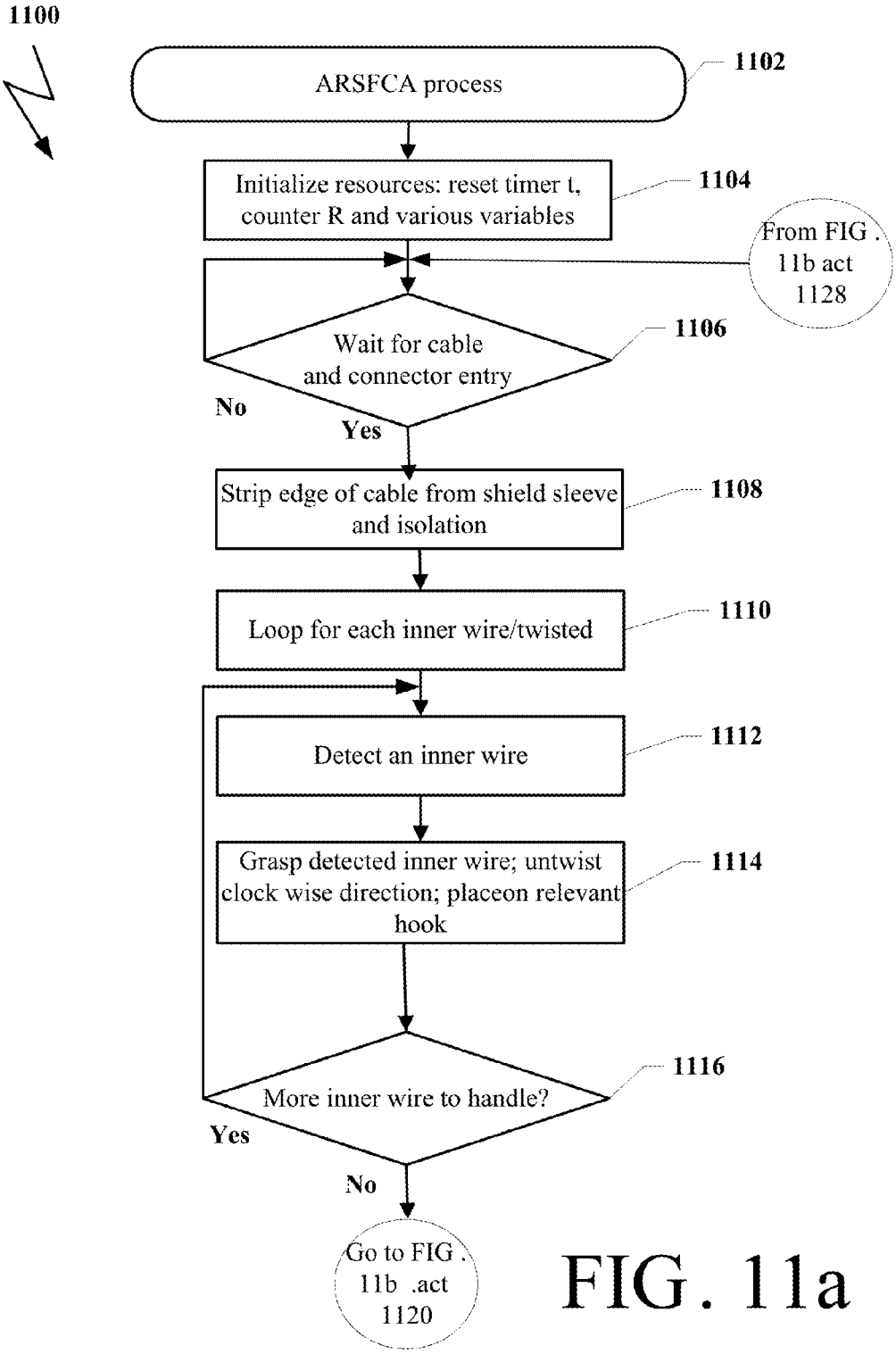
FIG. 11*a-b* is schematic illustrations of simplified flowchart with relevant acts of an examples of an automatic-robotic-system-for-cable assembly (ARSFCA) method, according to exemplary teaching of the present disclosure.
Figure 11B:
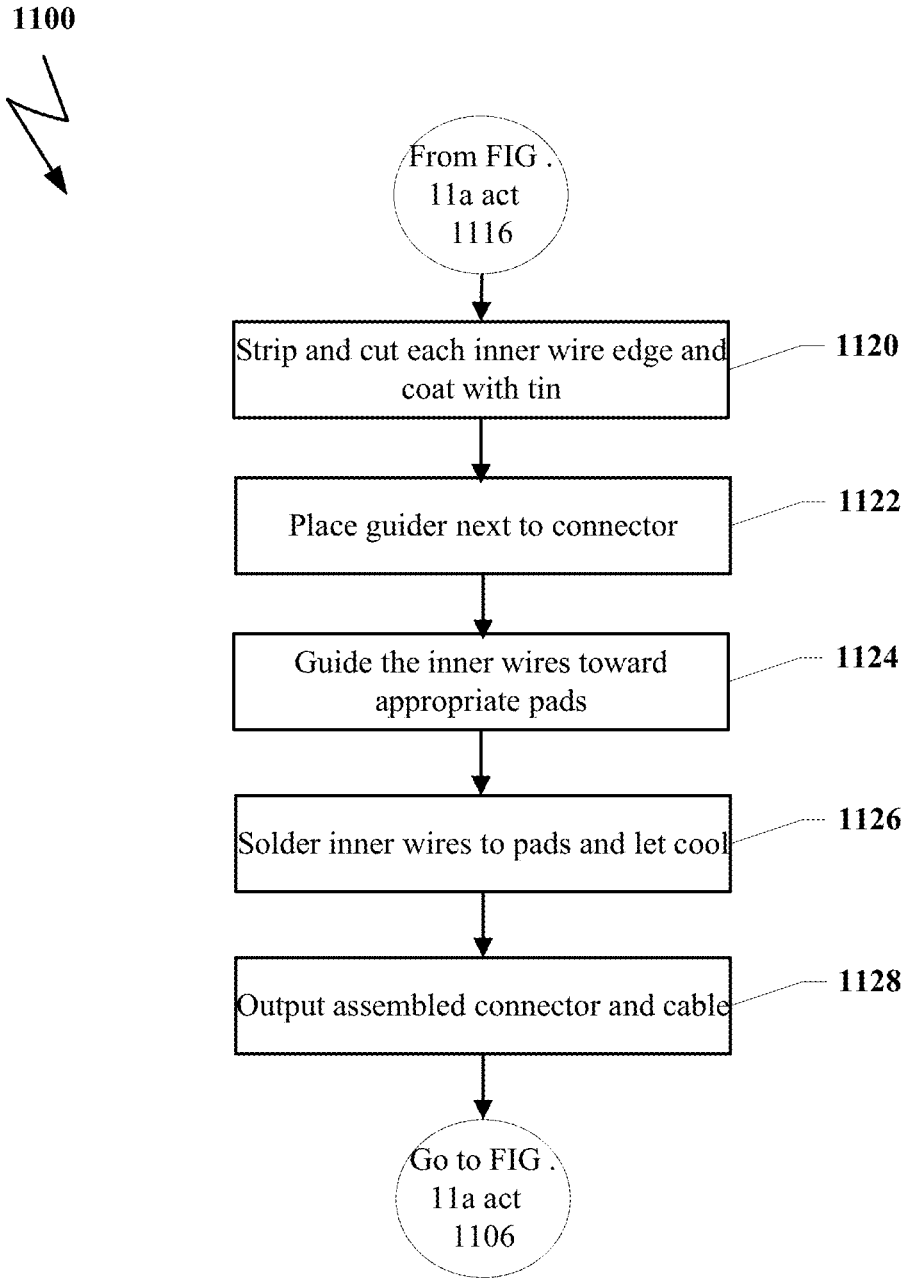

At act 1120 FIG. 11*b* ARSFCA method 1100 may strip 1120 and cut 1120 each inner wire edge and coat 1120 them with required coating substance (tin, for example). A guider and a connector may be synchronized 1122 in place. Next, the guider may guide 1124 the inner wires toward the relevant pads of the connector. A soldering iron may solder 1126 the inner wires to the relevant pads. Once cooled, the assembled connector and inner wires may be output 1128. ARSFCA method 1100 may then return to act 1106 in FIG. 11*a* and/or end.

Figure 12:
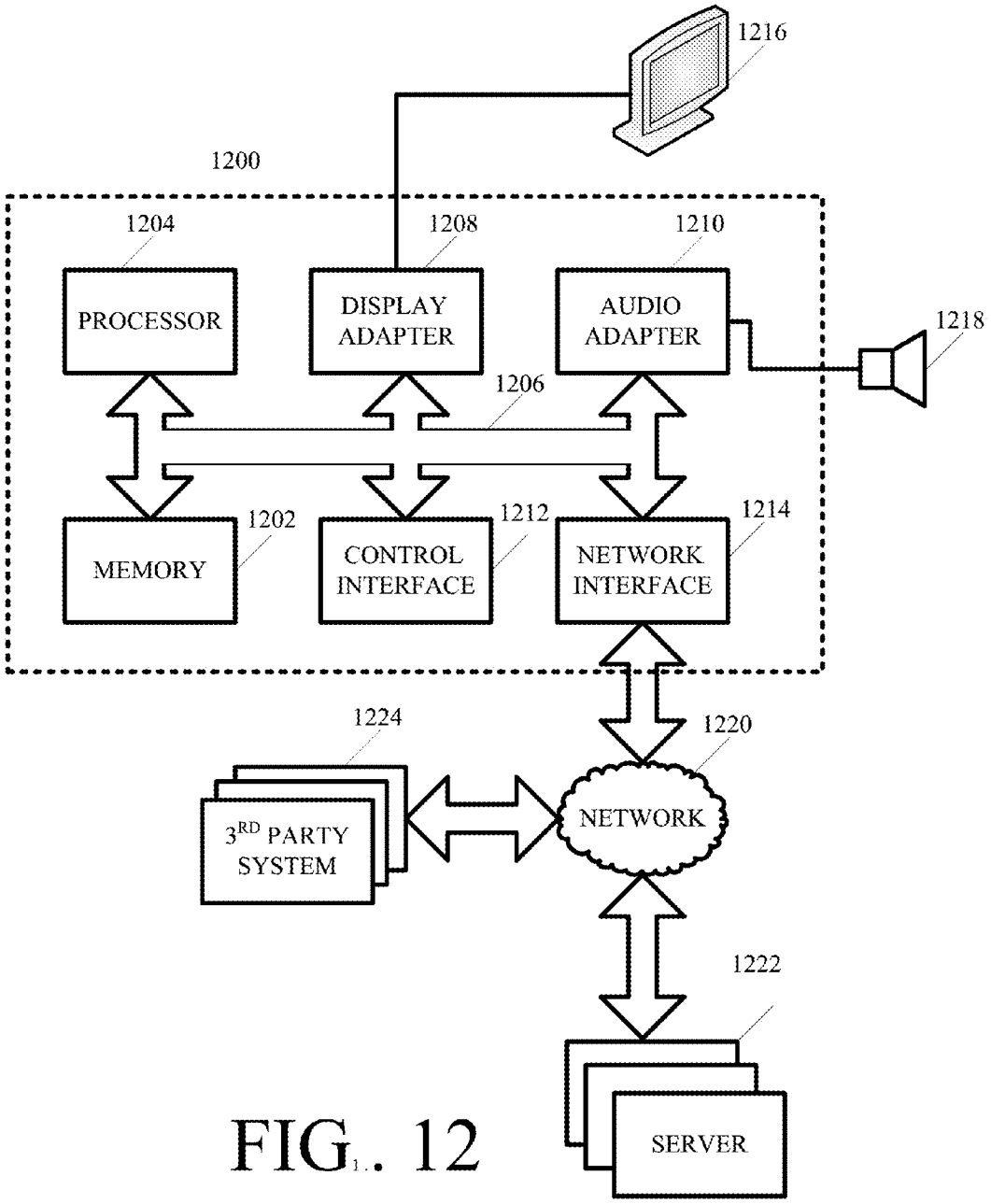
FIG. 12 is a schematic illustration of simplified block diagrams with relevant elements of examples of a controller of an automatic-robotic-system-for-cable assembly (ARSFCA), according to exemplary teaching of the present disclosure.

FIG. 12 is a functional block diagram of the components of an exemplary embodiment of system or sub-system operating as a controller or processor 1200 that could be used in various embodiments of the disclosure for controlling aspects of the various embodiments. It will be appreciated that not all of the components illustrated in FIG. 12 are required in all embodiments of a controller but, each of the components are presented and described in conjunction with FIG. 12 to provide a complete and overall understanding of the components.

The controller can include a general computing platform 1200 illustrated as including a processor 1204 and memory device 1202 that may be integrated with each other or communicatively connected over a bus or similar interface 1206. The processor 1204 can be a variety of processor types including microprocessors, micro-controllers, programmable arrays, custom IC's etc., and may also include single or multiple processors with or without accelerators or the like. The memory element of 1202 may include a variety of structures, including but not limited to RAM, ROM, magnetic media, optical media, bubble memory, FLASH memory, EPROM, EEPROM, etc.

The processor 1204, or other components in the controller may also provide components such as a real-time clock, analog to digital convertors, digital to analog convertors, etc. The processor 1204 also interfaces to a variety of elements including a control interface 1212, a display adapter 1208, an audio adapter 1210, and a network/device interface 1214. The control interface 1212 provides an interface to external controls such as, but not limited to: sensors, actuators, drawing heads, multiple-orifice nozzles, cartridges, pressure actuators, leading mechanism, drums, step motors, a keyboard, a mouse, a pin pad, an audio activated device, as well as a variety of the many other available input and output devices or, another computer or processing device or the like.

A display adapter 1208 can be used to drive a variety of alert elements 1216, such as, but not limited to: display devices including an LED display, LCD display, one or more LEDs or other display devices. An audio adapter 1210 may interface to and drive another alert element 1218, such as a speaker or speaker system, buzzer, bell, etc. A network/interface 1214 may interface to a network 1220 which may be any type of network including, but not limited to the Internet, a global network, a wide area network, a local area network, a wired network, a wireless network or any other network type including hybrids. Through the network 1220, or even directly, the controller 1200 can interface to other devices or computing platforms such as but not limited to: one or more servers 1222 and/or third party systems 1224. A battery or power source may provide power for the controller 1200.

Unless otherwise defined, all technical and/or scientific terms used herein have the same meaning as commonly understood by one of ordinary skill in the art to which the disclosure pertains. In case there is a conflict in the definition or meaning of a term, it is intended that the definitions presented within this specification are to be controlling. In addition, the materials, methods, and examples that are presented throughout the description are illustrative only and are not necessarily intended to be limiting.

Reference in the specification to "one embodiment" or to "an embodiment" means that a particular feature, structure, or characteristic described in connection with the embodiment is included in at least one embodiment of the disclosure, and multiple references to "one embodiment" or "an embodiment" should not be understood as necessarily referring to the same embodiment or all embodiments.

Implementation of the method and/or system of embodiments of the disclosure can involve performing or completing selected tasks manually, automatically, or a combination thereof. Moreover, according to actual instrumentation and equipment of embodiments of the method and/or system of the disclosure, several selected tasks could be implemented by hardware, by software or by firmware or by a combination thereof and with or without employment of an operating system. Software may be embodied on a computer readable medium such as a read/write hard disc, CDROM, Flash memory, ROM, etc. In order to execute a certain task, a software program may be loaded into or accessed by an appropriate processor as needed.

In the description and claims of the present disclosure, each of the verbs, "comprise", "include" and "have", and conjugates thereof, are used to indicate that the object or objects of the verb are not necessarily a complete listing of members, components, elements, or parts of the subject or subjects of the verb and further, all of the listed objects are not necessarily required in all embodiments.

As used herein, the singular form "a", "an" and "the" include plural references unless the context clearly dictates otherwise. For example, the term "a material" or "at least one material" may include a plurality of materials, including mixtures thereof.

In this disclosure the words "unit", "element", and/or "module" are used interchangeably. Anything designated as a unit, element, and/or module may be a stand-alone unit or a specialized module. A unit, element, and/or module may be modular or have modular aspects allowing it to be easily removed and replaced with another similar unit, element, and/or module. Each unit, element, and/or module may be any one of, or any combination of, software, hardware, and/or firmware. Software of a logical module can be embodied on a computer readable medium such as a read/write hard disc, CDROM, Flash memory, ROM, etc. In order to execute a certain task a software program can be loaded to an appropriate processor as needed.

The present disclosure has been described using detailed descriptions of embodiments thereof that are provided by way of example and are not intended to limit the scope of the disclosure. The described embodiments comprise different features, not all of which are required in all embodiments of the disclosure. Some embodiments of the present disclosure utilize only some of the features or possible combinations of the features. Many other ramifications and variations are possible within the teaching of the embodiments comprising different combinations of features noted in the described embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention.

It will be appreciated by persons skilled in the art that the present disclosure is not limited by what has been particularly shown and described herein above. Rather the scope of the disclosure is defined by the claims that follow.

We claim:

1. A cable assembly method, comprising:

stripping at least a part of a jacket from a cable, thereby exposing a plurality of inner wires twisted within the cable;

automatically detecting at least one aspect of one or more of the plurality of inner wires;

automatically selecting at least one of the plurality of inner wires based on the detected aspect;

automatically grasping the selected inner wire without grasping the jacket;

while grasping the selected inner wire, automatically moving the selected inner wire toward a wire holder such as to place the selected inner wire to touch the wire holder; and automatically electrically connecting the selected inner wire to a relevant pad at least partly while the selected inner wire is touching the wire holder.

2. The cable assembly method of claim 1, wherein automatically detecting at least one aspect of one or more of the plurality of inner wires comprises detecting inner-wire type.

3. The cable assembly method of claim 1, further comprising coating the selected inner wire with a coating substrate.

4. The cable assembly method of claim 3, wherein the coating substrate is tin.

5. The cable assembly method of claim 1, wherein the detecting is by image processing.

6. The cable assembly method of claim 1, further comprising partially stripping the selected inner wire.

7. The cable assembly method of claim 1 further comprising partially cutting the selected inner wire.

8. The cable assembly method of claim 1, wherein electrically connecting the selected inner wire to the relevant pad of a connector is by soldering.

9. The cable assembly method of claim 1, wherein electrically connecting the selected inner wire to the relevant pad a connector is by crimping.

10. The cable assembly method of claim 1, wherein the cable assembly method is configured for cable harness assembly.

11. The cable assembly method of claim 1, further comprising: after automatically grasping the selected inner wire, untwisting the selected inner wire from at least another of the plurality of inner wires.

12. The cable assembly method of claim 11, wherein untwisting the selected inner wire from at least another of the plurality of inner wires is performed prior to moving the selected inner wire to touch the wire holder.

13. The cable assembly method of claim 1, wherein the wire holder comprises a dent; and wherein the selected inner wire is automatically placed into the dent of the wire holder in order to at least partly hold the selected inner wire.

14. The cable assembly method of claim 13, wherein the dent is shaped to partly encircle the selected inner wire when the selected inner wire is placed into the dent.

* * * * *